United States Patent [19]

Gillum

[11] 4,227,439

[45] Oct. 14, 1980

[54] ANTI-BOUNCE APPARATUS FOR RECIPROCATING BOLT ASSEMBLIES OF AUTOMATIC CANNON

[75] Inventor: Richard R. Gillum, Marblehead, Ohio

[73] Assignee: Ares, Inc., Port Clinton, Ohio

[21] Appl. No.: 24,188

[22] Filed: Mar. 27, 1979

[51] Int. Cl.[3] ..... F41D 5/04

[52] U.S. Cl. ..... 89/190; 89/180; 89/198

[58] Field of Search ..... 89/180, 182, 183, 190, 89/198

[56] References Cited

U.S. PATENT DOCUMENTS

| | | | |
|---|---|---|---|
| 3,455,204 | 7/1969 | Stoner | 89/33 C |
| 3,566,744 | 3/1971 | Stoner | 89/125 |
| 3,648,561 | 3/1972 | Stoner | 89/11 |
| 3,960,053 | 6/1976 | Conley | 89/149 |
| 4,039,012 | 8/1977 | Cook | 145/29 R |

OTHER PUBLICATIONS 20 mm Oerlikon Light Vehicle Rapid Fire Weapon System, pp. 1–22, 34–36.

*Primary Examiner*—Stephen C. Bentley
*Attorney, Agent, or Firm*—Allan R. Fowler

[57] ABSTRACT

Anti-bounce apparatus for an automatic cannon reciprocating bolt assembly which includes a bolt, a bolt carrier and bolt mounted locking lugs, comprises means defining engagement surfaces contoured for enabling the forward moving carrier to cam the lugs into bolt locking relationship with a cannon breech at increasing velocity, without bouncing, carrier energy loss being thereby minimized and firing of a chambered shell by a carrier mounted firing pin being assured. Further comprising the anti-bounce apparatus is a plurality of inertially actuated locking collets connected to the bolt carrier for causing, responsive to impact of the carrier with the breech at the instant of firing, frictional locking between the carrier and portions of the cannon fixed to the breech, rearward bouncing of the carrier relative to the locking lugs, with consequent premature or erratic bolt unlocking, being thereby prevented.

12 Claims, 22 Drawing Figures

FIG. 6.
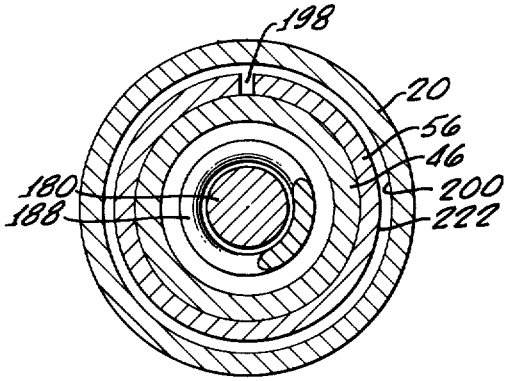
FIG. 7.
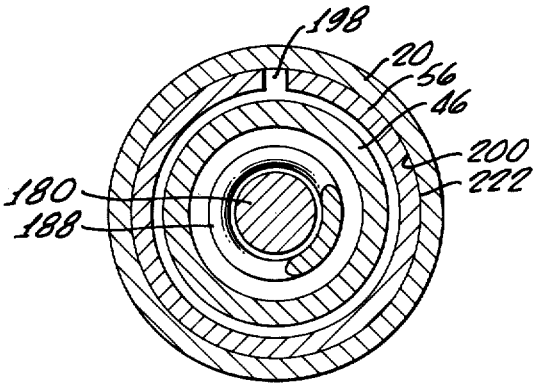
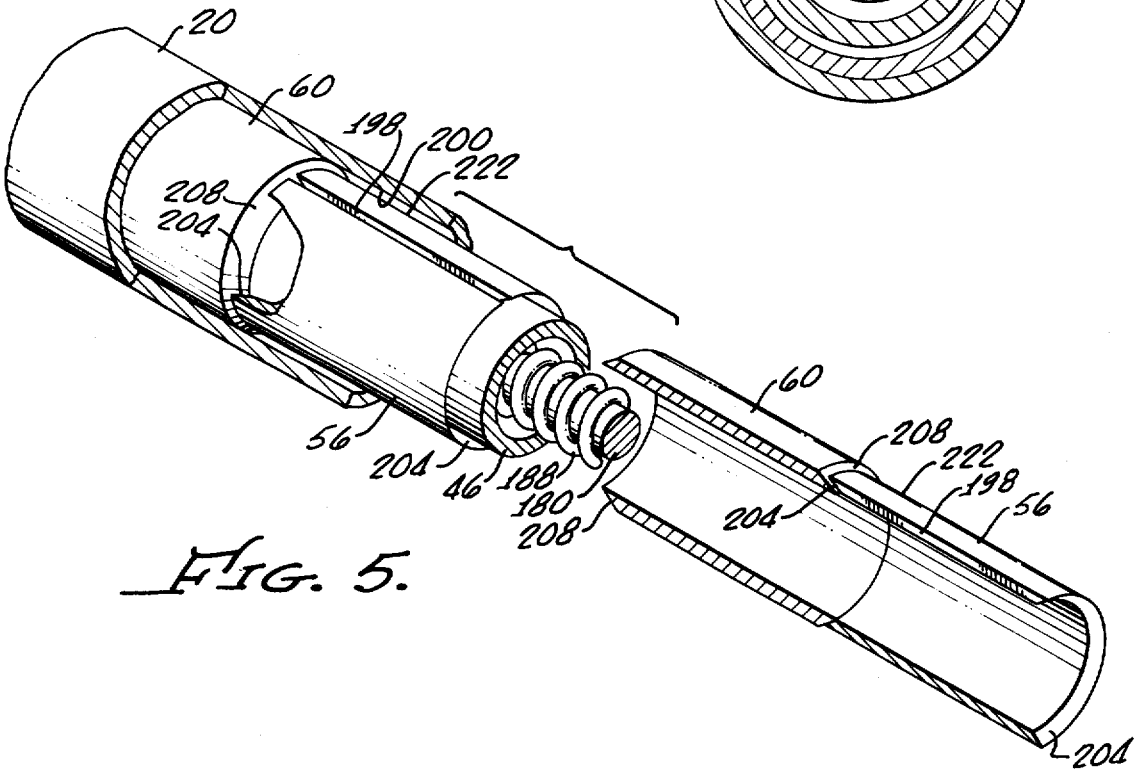
FIG. 5.

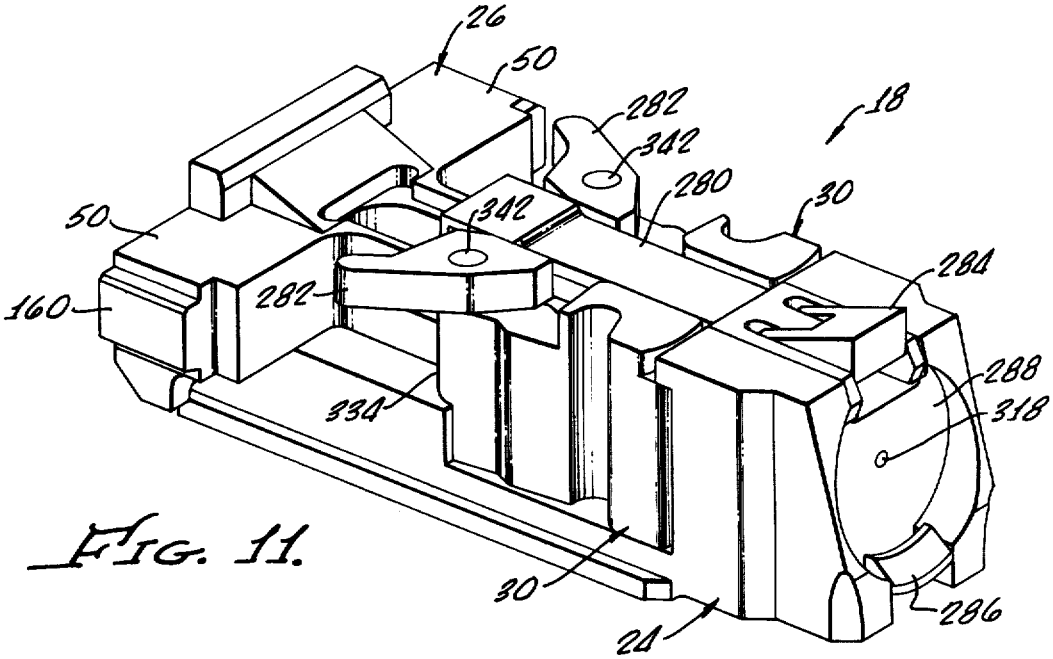
FIG. 11.
FIG. 8.
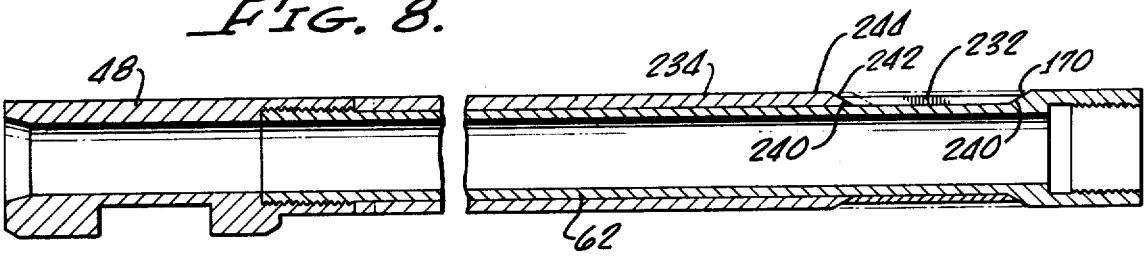
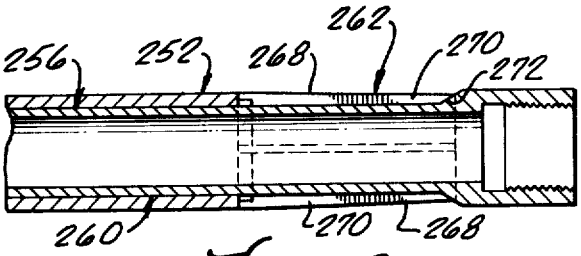
FIG. 9.
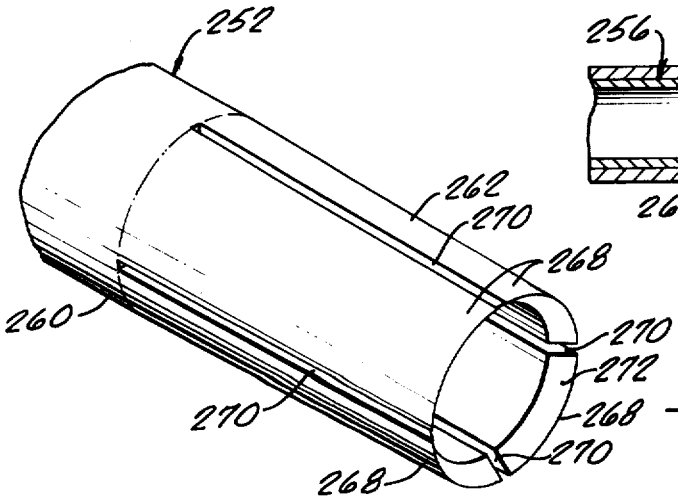
FIG. 10.

ANTI-BOUNCE APPARATUS FOR RECIPROCATING BOLT ASSEMBLIES OF AUTOMATIC CANNON

The present invention relates to bolt carrier apparatus for gas operated cannon or the like, and more particularly, to apparatus for enabling a bolt carrier to engage a cannon breech and operate bolt mounted locking lugs without bouncing of the bolt carrier from the breech or substantial slowing of the bolt carrier by the locking lugs.

Many large rapid fire automatic cannons employ a bolt assembly which comprises a bolt and bolt carrier slidably mounted together and adapted for reciprocal motion between a breech and a rearwardly mounted recoil buffer.

Typically, the bolt is locked to the breech by a pair of pivotally mounted locking lugs which swing outwardly into mating breech recesses. Such pivoting of the lugs may be caused solely by forward movement of the bolt as it reaches the breech or it may be caused or assisted by continued forward sliding movement of the bolt carrier relative to the bolt. After the lugs are pivoted outwardly into the breech recesses, continued movement of a forward interfering portion of the bolt carrier between the lugs prevent their unlocking, or withdrawal from the breech.

The bolt carrier forward portion typically includes a firing pin which impacts a shell primer for detonation of the projectile propellant as the bolt carrier reaches the limit of its forward motion relative to the bolt.

After firing, the breech or chamber gas pressure acts, through a piston or the like connected to the bolt carrier, to impart rearward movement to the bolt carrier, thus moving it out of an interfering position between the locking lugs. The lugs are then free to retract, either entirely by recoil forces acting on the lugs through the bolt or with assistance of the recoiling bolt carrier.

At rapid firing rates, the bolt and bolt carrier necessarily travel at very high recoil and counterrecoil velocities, hence, particularly with large cannon with correspondingly large bolt assemblies, the bolt assembly closes on the breech with high kinetic energy. Consequently, both the bolt and the bolt carrier tend to bounce rearwardly upon hitting the breech.

Because of the bolt carrier bouncing, the axial position of the bolt carrier at the instant of firing is unpredictable, the bolt unlocking time and hence the instaneous firing rate varying from one shot to the next. At rapid firing rates this irregularity tends to result in at least occasional malfunctions and jamming of the cannon.

In addition, when a shell fails to fire immediately upon the primer being impacted by the firing pin, bolt carrier bouncing can cause serious gun damage. Such "hang fires" are random occurances and appear characteristic of a certain percentage of shells fired. In a hang fire situation, the bolt carrier, upon bouncing, may be out of an interfering position between the bolt locking lugs at the instant of firing allowing the bolt to be easily moved by the exploding shell. When this happens the bolt may be recoiled at a destructive velocity.

Reduced bolt carrier bouncing is, in some types of guns, enabled by adding inertia weights to the bolt carrier in a manner permitting limited sliding of the weights relative to the bolt carrier in a direction parallel to the path of bolt assembly travel. Usually these weights are slidably mounted to one or more pistons which are fixed to the bolt carrier for reciprocal movement therewith. Weak springs hold the inertia weight at their rearward limit of travel along the pistons when the bolt carrier is not in motion.

When the bolt carrier forwardly impacts the breech, momentum causes the weights to continue to move forwardly against their springs. Thus, an instant after the bolt carrier hits the breech and starts bouncing rearwardly, the weights hit their forward limit of travel on the piston and exert, through the pistons, forwardly directed forces on the bolt carrier. Ideally, the forward impact forces of the inertia weights stop rearward movement of the bolt carrier and drive it forwardly into a full forward position.

However, upon impact at the forward limit of travel the inertia weights also bounce rearwardly and an instant later rearwardly impact the piston in a direction actually driving the piston and bolt carrier rearwardly from the breech. This secondary bouncing may cause the bolt carrier to move out of an interfering position between the locking lugs.

Means are therefore required, not only for minimizing bolt carrier bouncing, but also to keep the bolt carrier forwardly without secondary rebounding, until such time that the bolt carrier is intentionally recoiled by operation of chamber gas pressure.

Although the bolt assembly is driven at high velocities by breech gas pressure during firing, firing is commenced when the bolt assembly is released from a sear and driven forward, into engagement with the breech, by a set of drive springs or the like, which propell the bolt assembly at a much lower velocity.

Typically, percussion primed shells for large cannon require a rather sharp, hard impact by the firing pin to cause reliable ignition of the primer and projectile propellant. That is, without a sufficient impact, the shell may not fire, or it may be delayed in firing (hang fire).

Hence, the bolt carrier can not be significantly impeded or slowed as it is rammed into breech engagement by the drive springs, or the firing pin will not strike the first round with sufficient impact to fire it. Pivotal movement of the locking lugs, as mentioned previously, is typically caused by engagement with the bolt carrier. If this engagement is not programmed or smooth, bouncing may occur between the bolt carrier and the locking lugs which may slow the bolt carrier thereby causing mis- or hang-fire.

In accordance with the present invention for an automatic cannon having a breech and a bolt assembly mounted for axially reciprocating movement to and from the breech, the bolt assembly including a bolt and bolt carrier mounted thereto for relative axial movement therewith, bolt assembly anti-bounce apparatus includes a member connected to the bolt carrier for reciprocating movement therewith, and frictional locking means disposed between the member and portions of the cannon fixed to the breech when the bolt carrier is approximate to the breech.

Inertial means, in response to forward impact by the bolt carrier with the breech, cause the frictional locking means to releasably lock the member to the fixed portion of the cannon, thereby substantially preventing bouncing of the bolt carrier from the breech.

In an exemplary embodiment of the invention the member connected to the bolt carrier includes a piston which supports and guides the bolt carrier for reciprocal movement between the breech and the recoil buffer, and the inertial means includes a set of weights slidably mounted to the piston for movement therealong. The frictional locking means includes a set of expandable collets slidably mounted to the piston for movement therealong.

A stop portion on the piston disposed forwardly of the bolt carrier on a portion of the piston extending forwardly of the bolt carrier acts to stop the forward movement of the inertial weights and collets. The fixed portions include a cylinder substantially enclosing the piston, the weights and the expandable collets; further, each weight has a forward portion configured for expanding the collet upon impact therewith.

The bolt is locked to the breech by a pair of locking lugs pivotally mounted to the bolt in an opposing relationship which engage recesses in the breech. The bolt carrier is mounted for sliding engagement between the locking lugs thereby preventing unlocking of the lugs from the breech when the bolt carrier is positioned therebetween.

To prevent slowing of the bolt carrier which may be caused by an abrupt striking engagement with the locking lugs, means defining mating engagement surfaces on the locking lugs and the bolt carrier cause the locking lugs to continuously maintain contact with the bolt carrier as the bolt carrier slides forwardly toward the breech and between the locking lugs.

This invention provides anti-bounce apparatus to not only prevent the bolt assembly from bouncing with respect to the breech at continuous high firing rates, and consequently high bolt carrier velocities, but also to prevent slowing of the bolt carrier due to bouncing between the bolt carrier and the locking lugs which may occur during commencement of firing. These advantages and features of the invention will appear from the following description when considered in conjunction with the accompanying drawings, in which:

FIG. 1 is a perspective view of an automatic cannon having a buffer, bolt assembly, breech, barrel, and generally showing apparatus to prevent bouncing between the bolt assembly and the breech;

FIG. 2 is an enlarged perspective view of the buffer, bolt assembly including a bolt, bolt carrier and locking lugs, and breech portions of the cannon partially broken away to show a piston connected to the bolt carrier for reciprocating movement therewith, and generally showing apparatus for preventing bouncing between the bolt carrier and the locking lugs which would otherwise slow the bolt carrier as it moves toward the breech;

FIGS. 3*a* and 3*b* are a plan view of the buffer, bolt assembly, breech, and support cylinders with one cylinder partially cut away to show a piston and drive springs along with a set of inertial weights and a set of expandable collets for frictionally engaging the cylinder, the plan view being presented in two drawings for greater clarity;

FIGS. 4*a* and 4*b* are an enlarged plan view of one of the support cylinders cut away to show the piston, driving spring and frictional locking collets disposed between the piston and the cylinder, the enlarged plan view being presented in two drawings for greater clarity;

FIG. 5 is an enlarged perspective view of a cylinder, piston, springs, inertial weights, and collets exploded to show the relationship therebetween; also shown are portions of the weights and collets configured for causing expansion of the collets;

FIG. 6 is an enlarged cross-sectional view of the cylinder, piston, springs, inertial weights and collets showing the collet in an unexpanded condition;

FIG. 7 is a view similar to FIG. 6 showing the collet expanded and in frictional engagement with the cylinder;

FIG. 8 is a cross-sectional view of the piston in a second embodiment of the invention and showing a single expandable collet and a single inertial weight;

FIG. 9 is a partial cross-sectional view of the piston in a third embodiment of the invention and showing a single inertial weight with an expandable portion thereon configured for expanding as the inertial weight strikes a shoulder or stop portion of the piston;

FIG. 10 is an enlarged perspective view of the embodiment of FIG. 9 showing a forward end portion of the inertial weight configured to enable expansion thereof upon impact with the piston shoulder;

FIG. 11 is an enlarged perspective view of the bolt assembly showing the bolt, bolt carrier, locking lugs, a case extractor and a pick up element and generally showing apparatus to prevent bouncing between the bolt carrier and the locking lugs;

Figure 13:
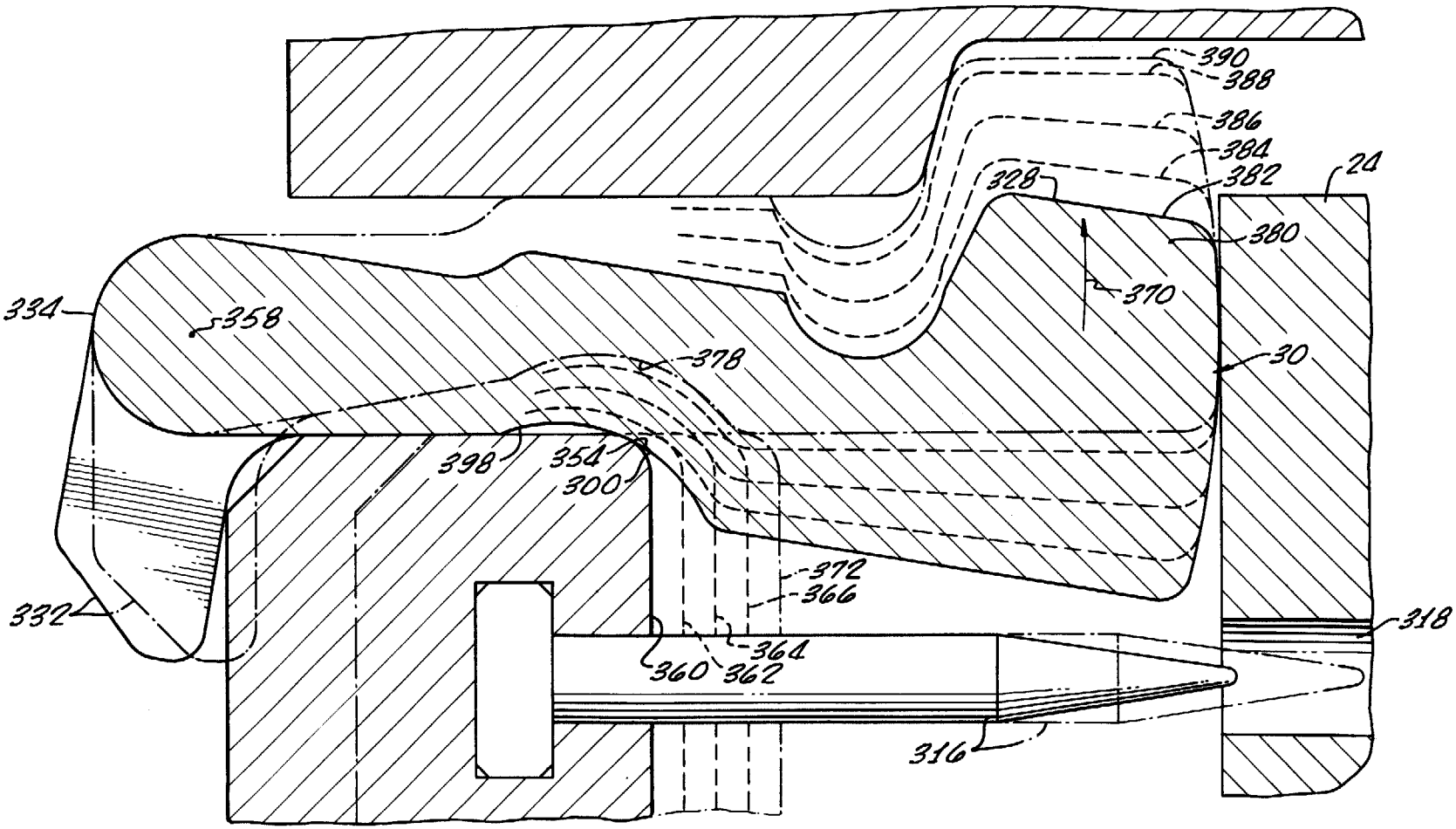
Figure 14:
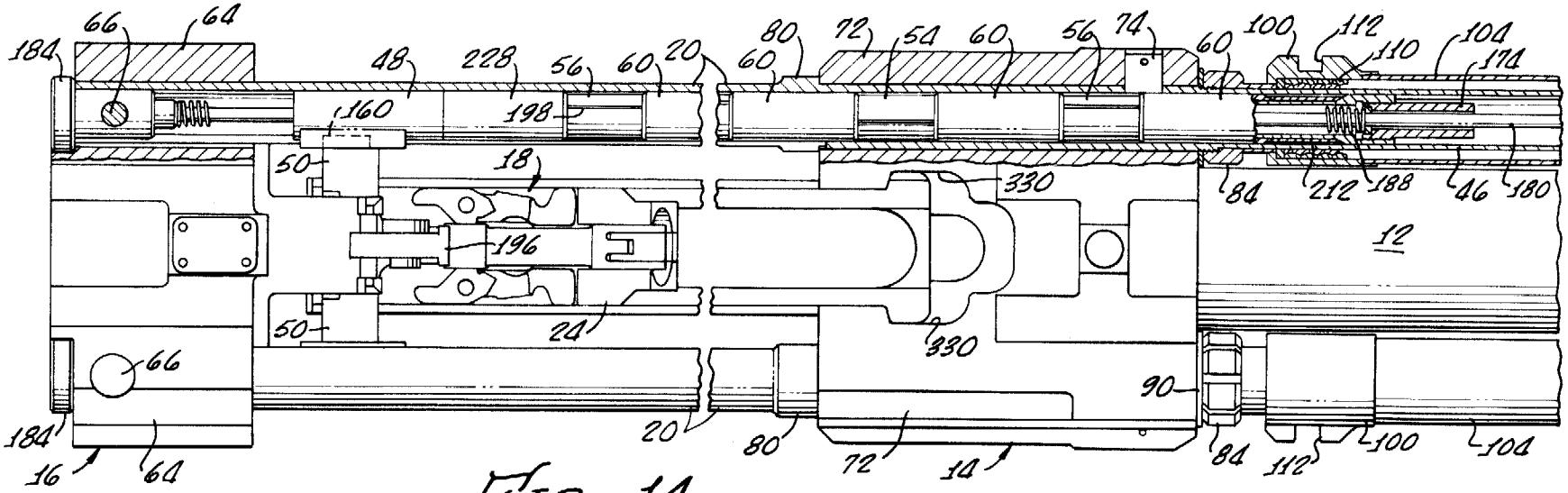
Figure 15:
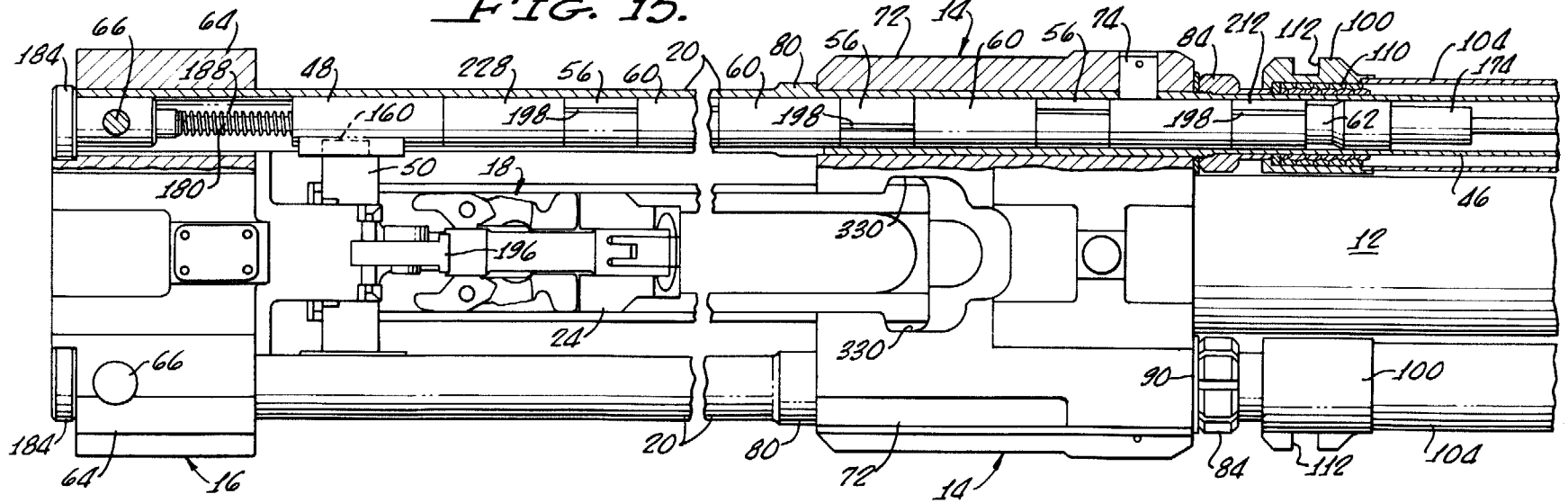
Figure 16:
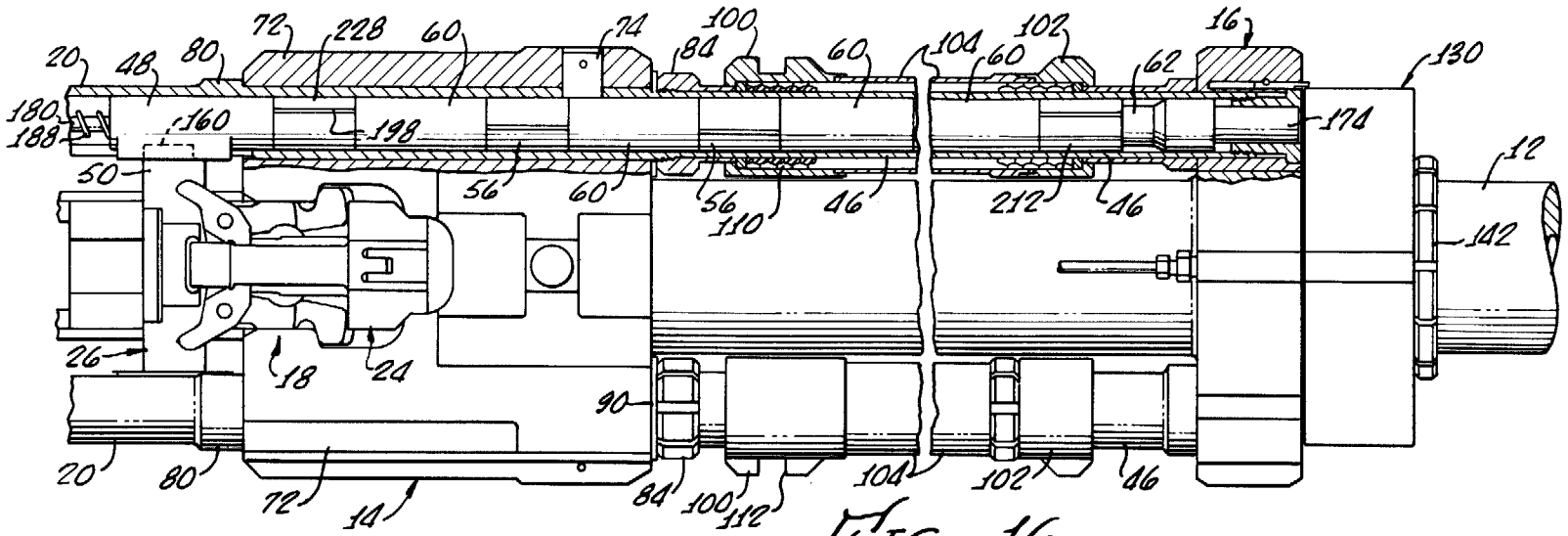
Figure 17:
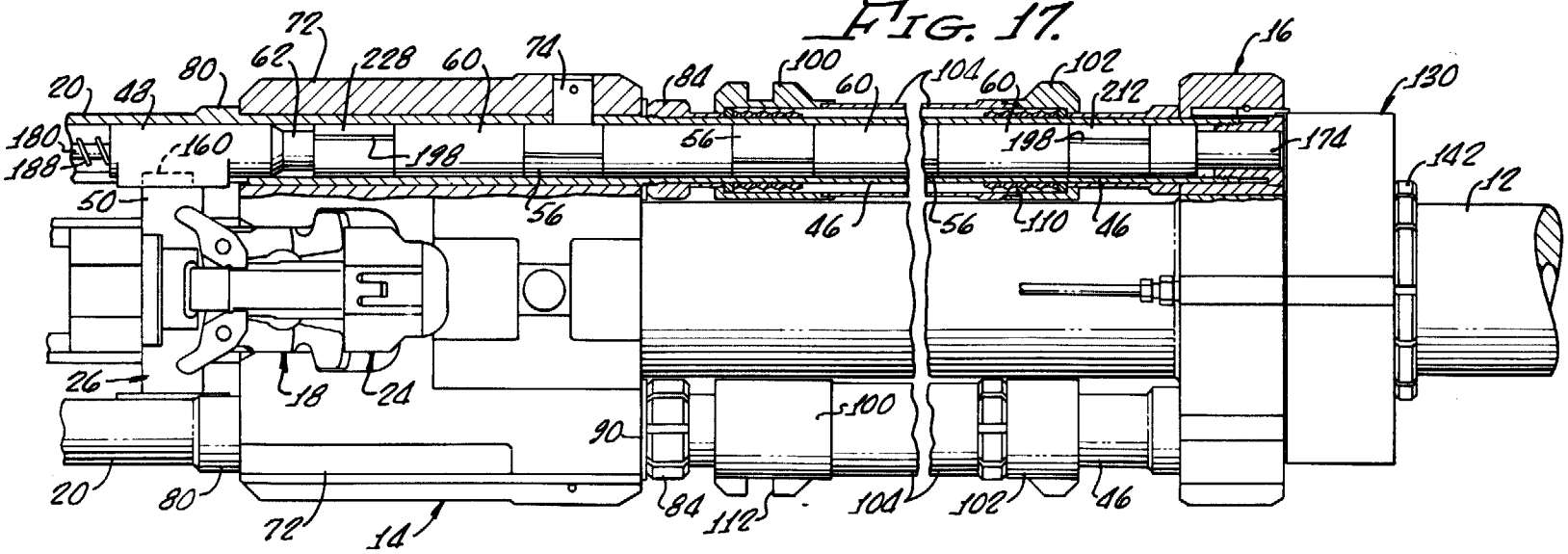
Figure 18:
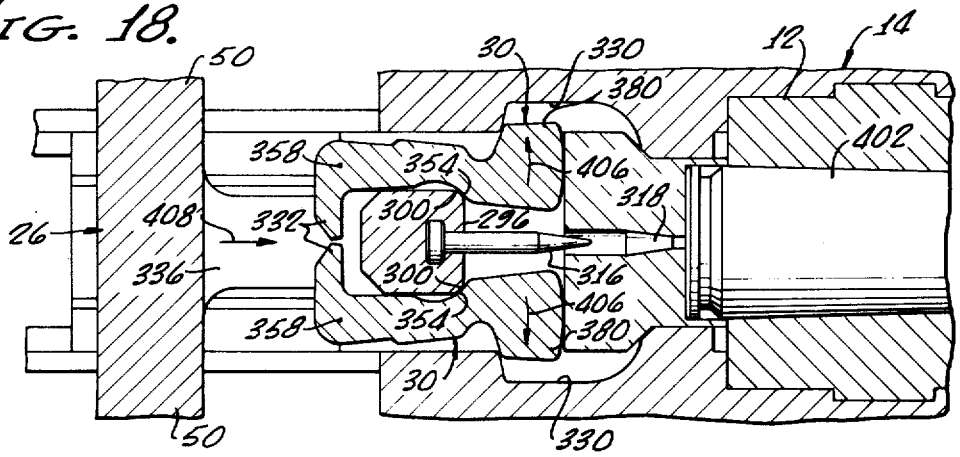
Figure 19:
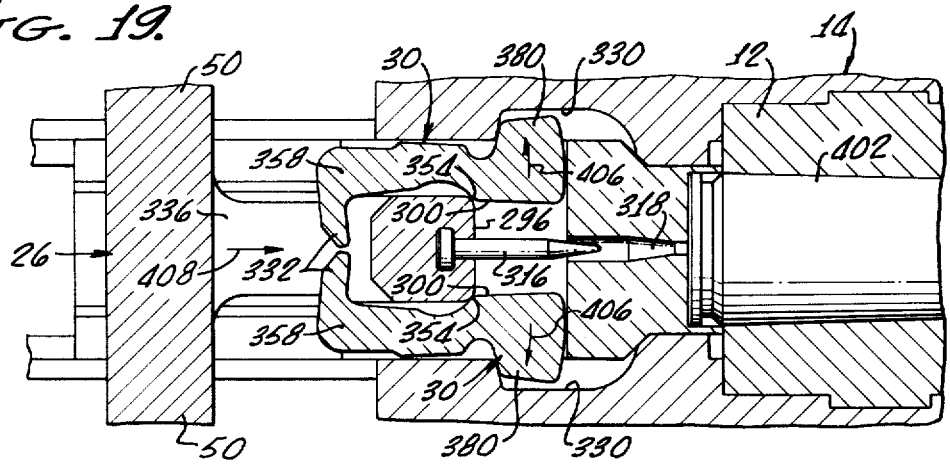
Figure 20:
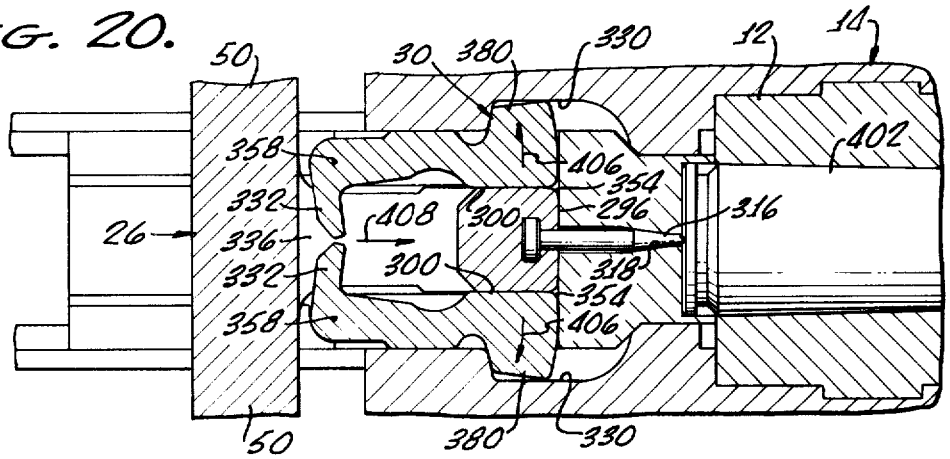

FIG. 13 is an outline of a locking lug and a bolt carrier face showing, in a sequential or "strobe" like manner, rotational movement of the locking lug in response to translational movement of the bolt carrier and predetermined engagement surfaces on both the locking lug and the bolt carrier for causing the locking lug to rotate with increasing velocity as the bolt carrier slides therebetween, a single locking lug being shown for greater clarity;

FIG. 14 is a plan view of the bolt assembly and support cylinders with one cylinder cut away to show the inertial weights and collets remaining at a forward position at the instant of the bolt assembly impacting the buffer after recoil with the drive springs in a compressed state;

FIG. 15 is a plan view similar to FIG. 14 showing the inertial weights and collets at a rearward position following recoil of the bolt assembly after firing;

FIG. 16 is a plan view similar to FIGS. 14 and 15 showing the position of the inertial weights and collets at the rear of the cylinder at the moment of impact of the bolt assembly with the breech;

FIG. 17 is similar to FIGS. 14, 15, and 16 showing the inertial weights and collets forwardly impacting the piston shoulder, or stop, portion and one another within the cylinder a moment after bolt carrier impact with the breech, the collets being expanded and frictionally engaging the cylinder thereby preventing bouncing of the bolt carrier from the breech;

FIG. 18 is a plan of view of the bolt carrier striking the breech of the cannon with the locking lugs just beginning to move outwardly into an engagement with recess portions of the breech assembly;

FIG. 19 is a plan view similar to FIG. 18 showing the continued movement of the locking lugs into the recesses as the bolt carrier moves forward relative to the bolt; and, FIG. 20 is a plan view similar to FIGS. 18 and 19 showing the bolt and bolt carrier in firing position with the firing pin extending past a bolt face, the locking lugs fully engaging the breech recesses and the bolt carrier being disposed between the locking lugs to prevent outward movement thereof from the breech recesses.

Figure 1:
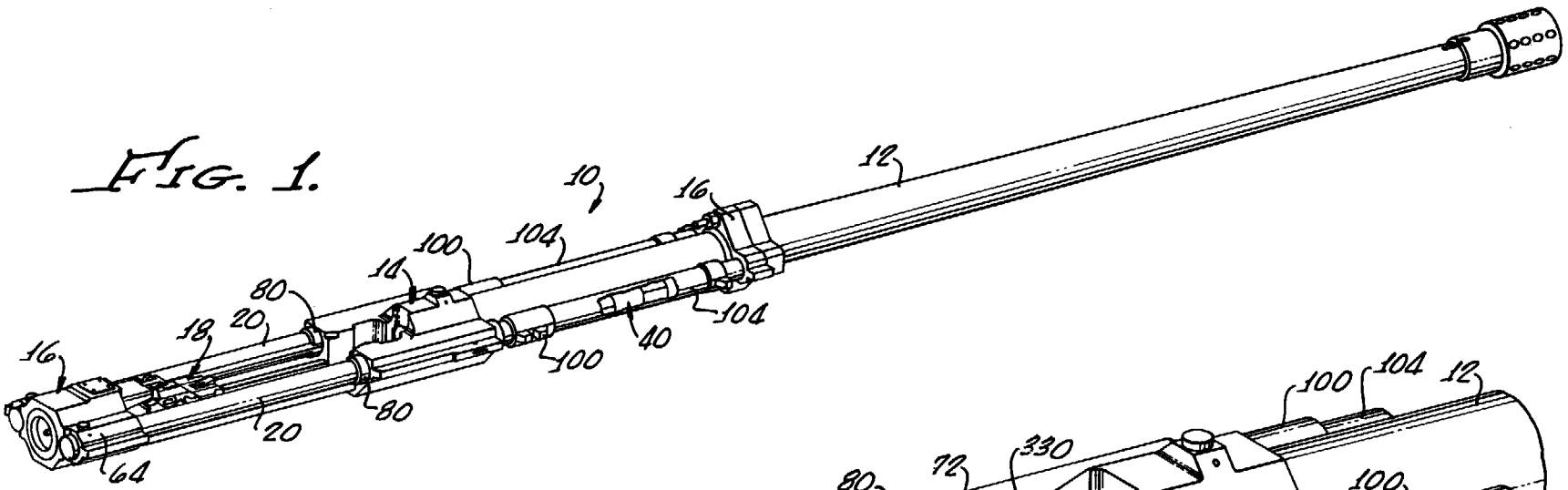

FIG. 1 shows an automatic cannon 10 having a barrel 12, breech 14, recoil buffer 16 and a bolt assembly 18 mounted for reciprocal movement between the breech and the recoil buffer along a pair of support cylinders 20. As more clearly shown in FIG. 2 the bolt assembly 18 includes a bolt 24, a bolt carrier 26 and bolt locking lugs 30.

In general, anti-bounce provisions for the bolt assembly 18 include apparatus 40 (FIG. 1) for preventing bouncing of the bolt carrier 26 from the breech 14 upon engagement therewith for firing a shell (not shown) and apparatus 42 (FIG. 2) for preventing bouncing between the locking lugs 30 and the bolt carrier 26 which may slow the bolt carrier. The latter is particularly important when the bolt assembly is driven by a pair of drive springs 44 to initiate gun fire.

The description of the anti-bounce provisions is herewithin separated, for clarity of presentation, with the apparatus 40 for preventing bouncing of the bolt carrier 26 from the breech 14 being presented first, followed by a description of the apparatus 42 for preventing bouncing between the locking lugs 30 and the bolt carrier 26. Following the structural description of the apparatus, a discussion of operation and function will be presented.

In general, the anti-bounce apparatus 40 as shown in FIGS. 3*a*, 3*b*, 4*a*, and 4*b* includes a pair of pistons 46 including end sleeves 48 screwed thereto and fixed to bolt carrier arms 50, for reciprocating movement therewith, only one of the pistons being shown. Associated with each piston 46 are a set of expandable collets 56 and a set of inertial weights or sleeves 60 slidably mounted to a piston central portion 62. The set of collets provide frictional locking means, as hereinafter described in greater detail, and is disposed between the pistons 46 and the cylinders 20 which in turn are fixed to the breech 14 and the buffer 16.

The support cylinders 20 are held in a generally parallel spaced apart relationship by the buffer 16 and the breech 14 and are fixed to a buffer housing 64 by a pair of removable pins 66 to enable easy removal of the buffer housing 64 and bolt assembly 18 rearwardly from the cylinders 20, thereby providing ready access to the breech 14 and anti-bounce apparatus 40.

A pair of holes 70 (FIG. 2) bored in breech outboard portions 72 enable the support cylinders 20 to extend forwardly therethrough. A pair of keys 74 (FIGS. 3*b*, 4*a*) extending into mating notches 76 in the cylinders 20 prevent rotation of the cylinder 20 within the breech 14. The cylinders are held to the breech by shoulders 80 which bear against a rear end 82 of the breech and ring nuts 84 screwed on to threaded portions 86 of the cylinders which bear against washers 90 and an end surface 92 of the breech to thereby preventing axial motion of the cylinders 20 with respect to the breech 14.

Although not part of the present invention, also shown are a pair of barrel recoil or shock absorbers 98 which are fixed to the support cylinders 20 forwardly of the breech 14 and disposed exterior to the cylinders. Briefly, these recoil or shock absorbers consist of end caps 100, 102 screwed onto a connecting cylinder 104, stop rings 106 and a set of ring springs 100 disposed between the support cylinder 20 and the connecting cylinder 104. The end cap 100 is formed with a notch 112 therein to enable mounting of the cannon 10 to a suitable cannon frame, not shown.

The support cylinder 20 is held to the barrel 12 by means of a sleeve 114 thereabout bearing against a collar 116 surrounding the barrel 12 and a collar nut 118 (FIGS. 3*b*, 4*b*) screwed into a threaded end portion 120 of the cylinder 20. A pin 122 is biased by a spring 124 into engagement with a head portion 126 of the collar nut 118 to prevent loosening of the collar nut and thereby prevent the cylinder 20 from becoming loose within the collar 116.

As hereinafter described in greater particularity, a pair of actuator assemblies 130 (one shown in FIGS. 3*b*, 4*b*) each include a piston 132 disposed within a cylindrical cavity 134 having a gas feed port 136 which is aligned with a gas tap, or port opening 138 communicating with the barrel interior 140. The actuator assemblies 130 are held in an aligned position with the pistons 46 by means of ring nuts 142 screwed to threaded portions 144 of the barrel 12 to wedge the actuator assemblies 130 against shoulders 146 formed in the barrel.

Figure 4A:
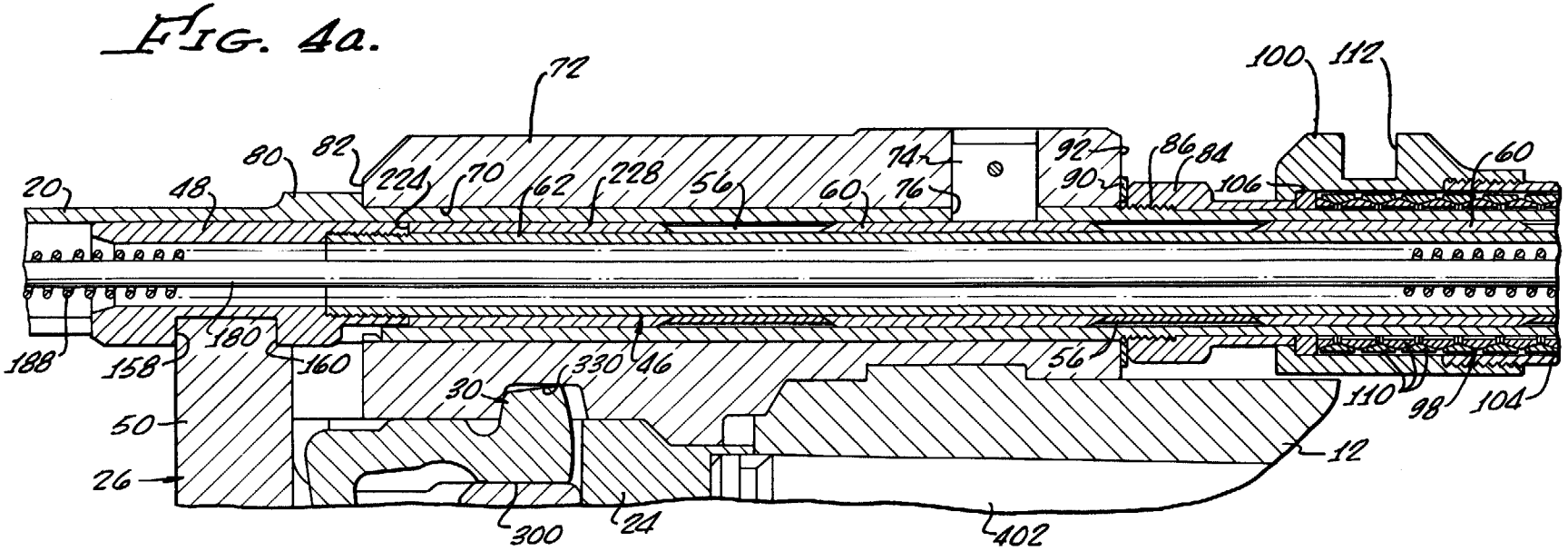

As previously mentioned, the pistons 46 are disposed within the cylinders 20 and attached to the bolt carrier arms 50, by means of end sleeves 48 (FIG. 4*a*). Each end sleeve 48 has a notch 158 therein configured for accepting mating portions 160, on the bolt carrier arms 50.

The pistons 46 extend forwardly of the bolt carrier 26 and have forward ends or stop portions 166 (FIG. 4*b*) with rearwardly facing tapered shoulders 170 and a forward extension 174 screwed therein.

In brief, the pistons 46 operate to disengage the bolt carrier 26 from the breech 14 after firing by means of residual barrel gas pressure. Gas pressure is taken from the barrel interior 140 by the taps 138 and conveyed to the cavities 134 by means of the ports 136. The gas pressure rams the pistons 132 rearwardly into engagement with the forward extensions 174, thus ramming the pistons 46, along with the bolt carrier 26, rearwardly toward the buffer 16. The pistons 132 have a relatively short stroke but impart sufficient energy to the pistons 46 to first push the bolt carrier 26 from an interfering position between the bolt locking lugs 30 and then push the bolt assembly 18 to the buffer 16, as will be hereinafter described in greater detail.

Figure 3A:
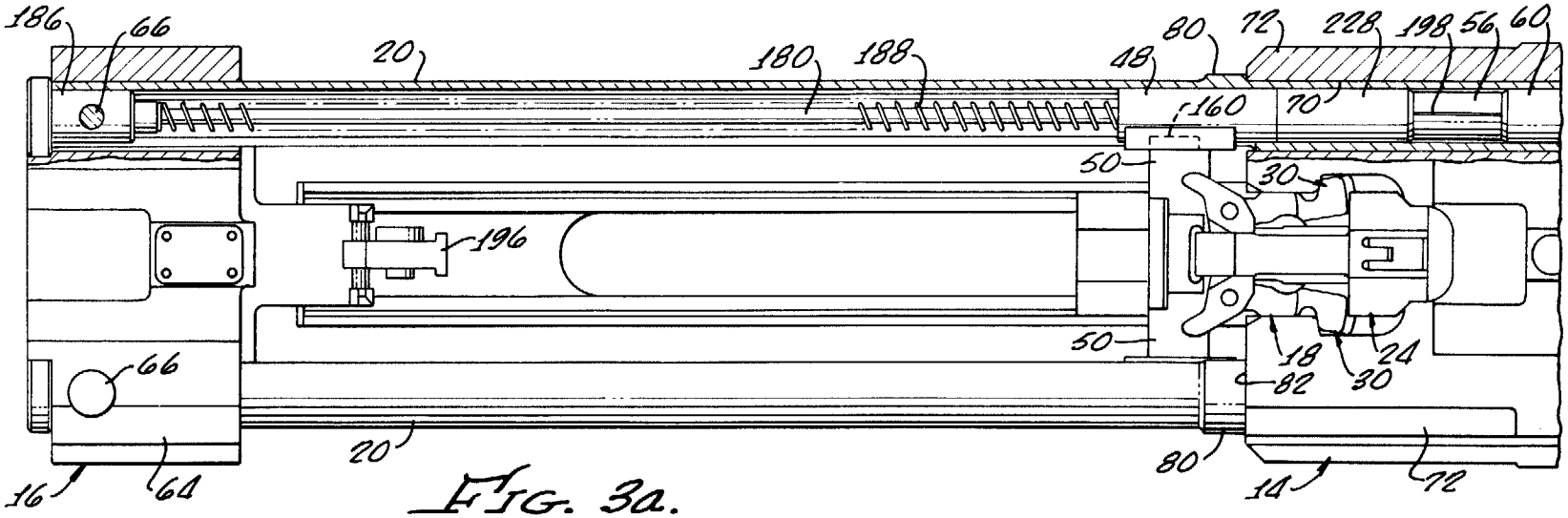
Figure 3B:
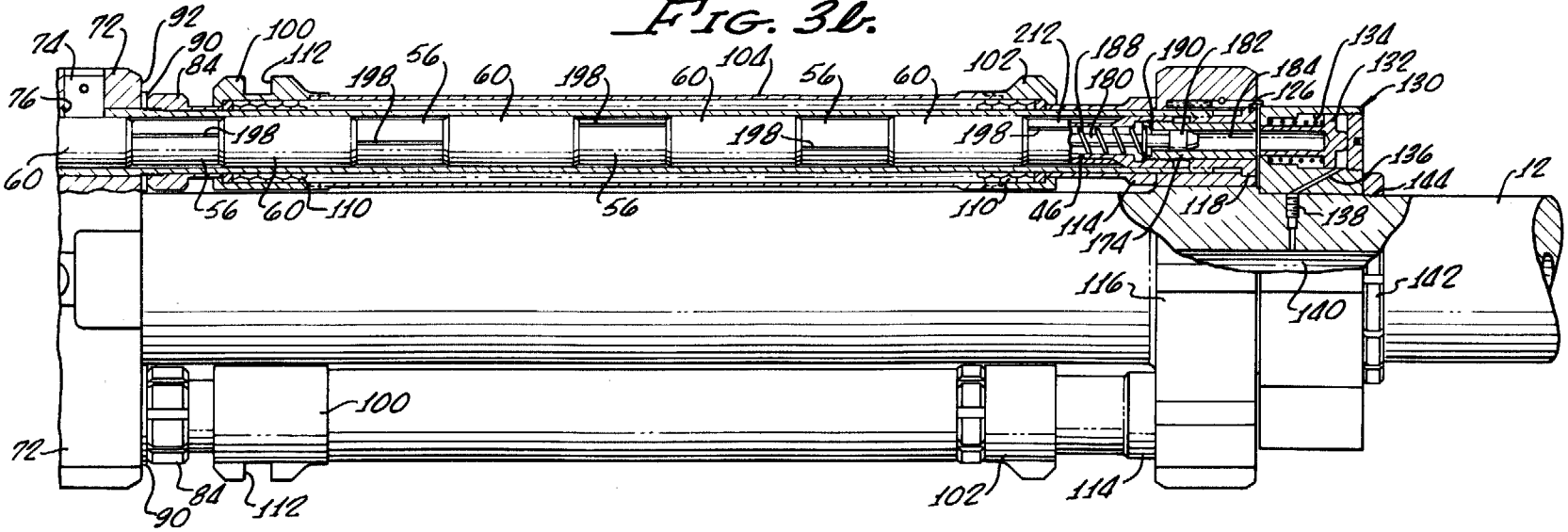
Figure 4B:
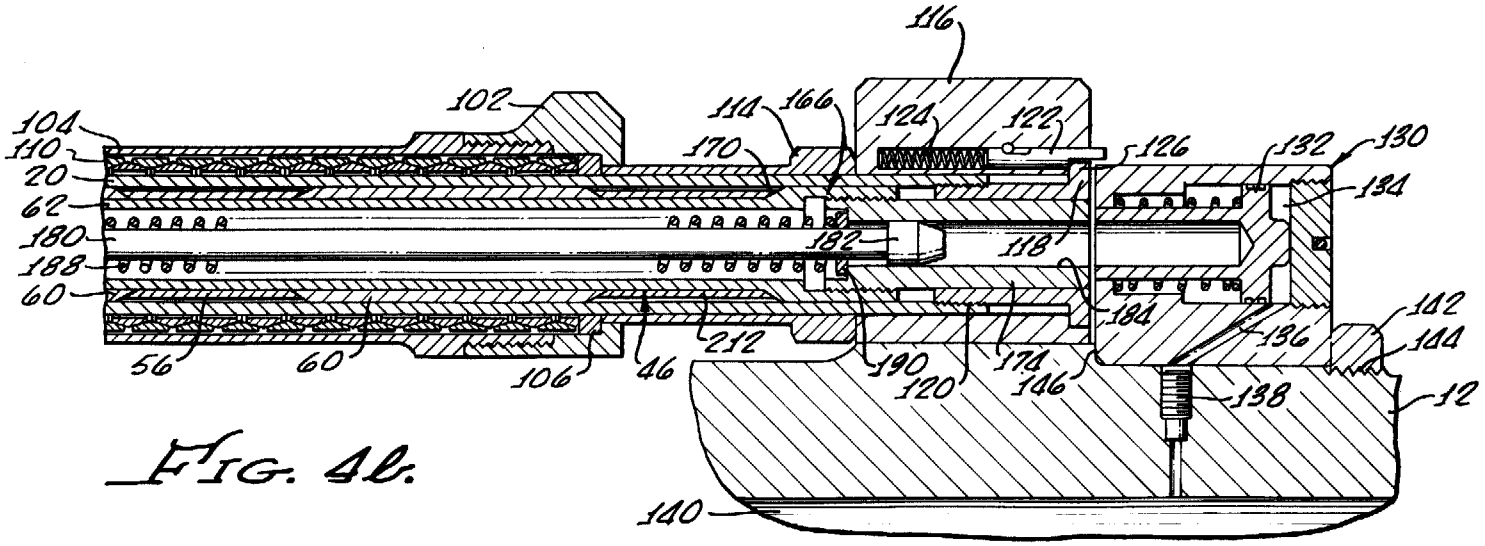

Disposed interiorly of the pistons 48 are guide rods 180 (FIGS. 3*a*, 3*b*, 4*a*, 4*b*) having forward heads 182 thereon sized to permit sliding engagement with an interior surface 184 (FIGS. 3*b*, 4*b*) of the forward extensions 174 of the pistons 46. The rods 180 extend rearwardly of the bolt carrier 26 and terminate in the buffer housing 64 where they are fixed to end caps 186 (FIG. 3*a*) which in turn are fixed to the cylinders 20 and the pistons 46. Drive springs 188 are disposed about the rods 180 and extend from the end caps 186 to forward washers 190 (FIGS. 3*b*, 4*b*). The drive springs are compressed as the pistons 46 are driven rearwardly by the residual gas pressure after firing. When the bolt assembly 26 is held in a rearward position by a sear 196 (FIG. 2) upon ceassation of firing, the compressed drive springs store sufficient energy to subsequently ram the bolt assembly 18 forward to commence firing upon unsearing of the bolt assembly.

As best seen in FIG. 5 the collets 56 are generally cylindrical in shape and each preferably have a longitudinal slit 198 therein which enables outward radially directed expansion of the collets, increasing the width of the slits 198 so that the collets 56 can engage inside surfaces 200 of the cylinders 20.

Each of the collets 56 have slanted, or ramp, end surfaces, or portions, 204 for engagement with corresponding slanted, or ramp end, surfaces, or portions, 208 on each weight 60. It should be noted that the collets are substantially identical in size and configuration and that upon assembly over the pistons 46, the forward ends 208 of the foremost collets 212 are positioned to engage the shoulders 170 of the pistons 46 (FIG. 4*b*) when the collets are in a most forward position. Hence when the collets 56 are pushed toward one another as the inertial weights 60 move forward, each collet is wedged between the weights, or in case of the foremost collets 212, the shoulders 170 and a weight, and are expanded thereby into frictional engagement with the cylinders 20.

FIGS. 6 and 7 show the collets in cross-section in an unexpanded and expanded position respectively. Since the collets are "wedged" from each end, expansion of the collets occurs substantially along the length thereof, thereby providing large frictional engagement surfaces 222 for bearing on the cylinder interior surfaces 200. It should be appreciated that the number, length and thickness of the collets 56 as well as the angle of the ramp surfaces 204, necessary to provide sufficient collet expansion and frictional engagement between the cylinder interior surfaces 200 and the collets depend upon the weight of the bolt assembly 16 and rate of gun fire among other factors.

It should be noted that rearward ends 224 of the rearmost weights 228 (FIG. 4*a*) do not operate to expand a collet 56 and hence do not have a ramp thereon.

FIG. 8 illustrates another embodiment of the invention wherein a single collet 232 similar in configuration and function to the collets 56 and a larger single weight 234, Both slidably disposed over the piston central portions 62 between the shoulders 170 and the end sleeve 48. The collet 232 has a ramp end surface 240 configured for mating engagement with the shoulders 170 and ramp surfaces 242 disposed on forward ends 244 of the weight 234. The collets 232 are split in a similar manner described for the set of collets 56 and the operation and interaction between the weight and the collet and shoulder is substantially the same as that described in connection with the set of collets 56 and weights 60, whereby forward movement of the weights 234 against the collets 232 wedges the collets 232 between the shoulders 170 and the weights 234 thus expanding it into contact with the interior surface 200 of the cylinder 20 to provide a momentary frictional lock as the bolt carrier 26 engages the breech 14.

Still another embodiment is shown in FIGS. 9 and 10, wherein a combination weight and collet 252 is slidably disposed on each piston central portion 62 between the shoulders 170 and the end sleeves 48. The combination weight collet 252 includes a rear portion 260 having a solid, or uninterrupted circumference and a forward portion 262 which may have four expandable segments 268, formed in the weight 256 by a set of slots 270. The forward portion 262 of each weight 252 has a ramp surface 272 configured for engagement with the shoulders 170 formed on the pistons 46. The slots 270 lengths and widths are configured so that the expandable portions 268 are sufficiently pliable to permit expansion thereof as the weight rams forward into the shoulder thus wedging the forward end segments 268 between the shoulders and the cylinder interior surface 200 to cause a momentarily frictional locking therebetween.

It is to be appreciated that the length of the single collet 232 and the slit portion of the combination weight and collet 252, should be long enough, as empirically determined, to provide sufficient engagement area with the cylinder interior surfaces 200, so as to prevent bolt carrier bouncing.

Figure 12:
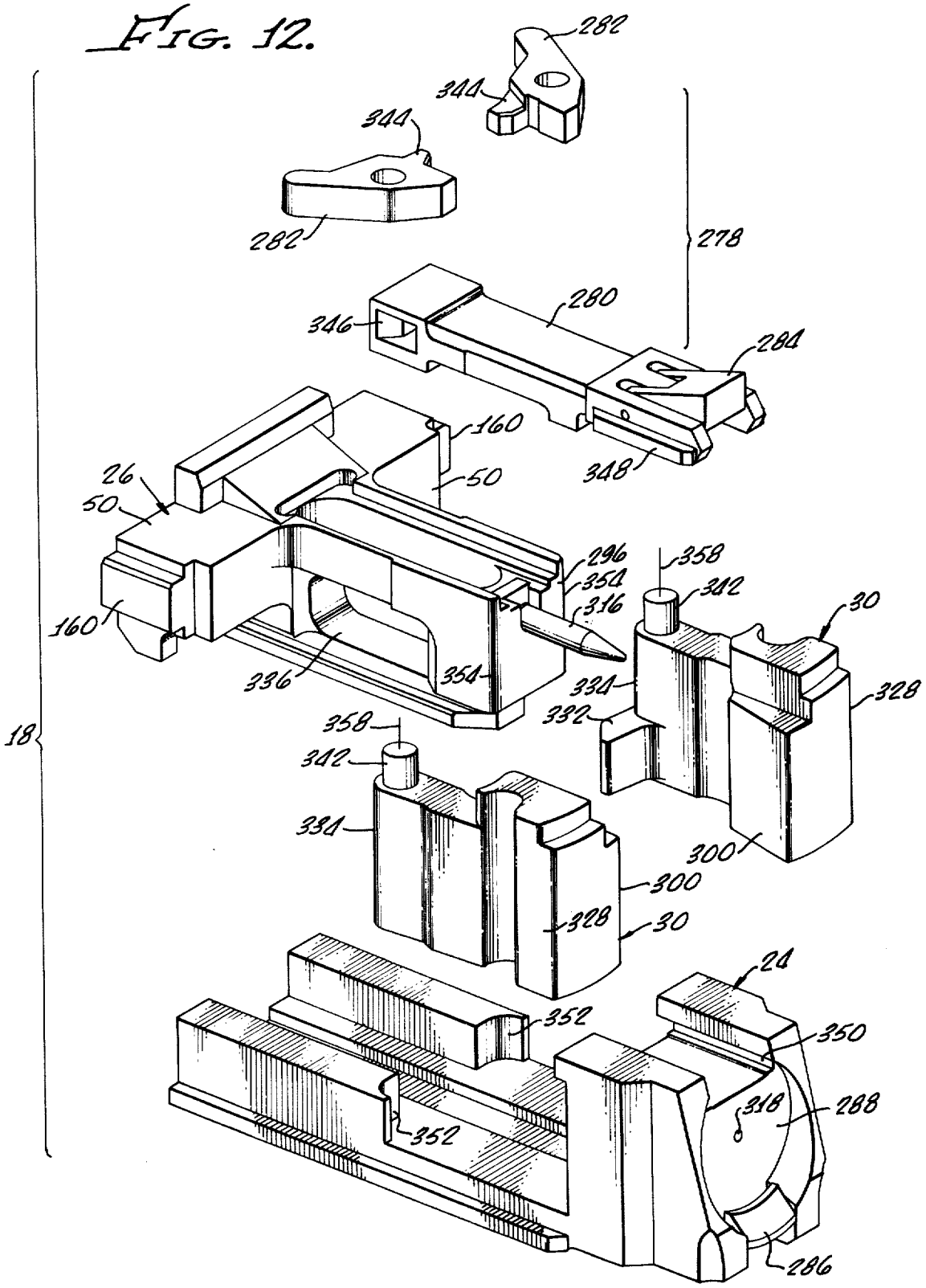
FIG. 12 is an exploded perspective view of the bolt carrier assembly showing in greater detail the locking lugs, an extractor member assembly, a pick up element, the bolt carrier, bolt and firing pin.

Turning now to a discussion of the apparatus 42 for preventing slowing down of the bolt carrier 26 by bouncing which may occur between the bolt carrier 26 and the locking lugs 30, attention is directed to FIGS. 11, 12 and 13. FIGS. 11 and 12 generally show the bolt assembly 18 which includes the bolt 24 and bolt carrier 26. Also shown, for illustrative and descriptive purposes and not part of the present invention, are an ejector apparatus 278 with an ejector member 280 and actuation members 282, a pick up element 284 for stripping live shells from an automatic feeder (not shown) and a shell casing extractor 286 mounted at a bolt face 288.

The bolt carrier 26 is slidably mounted to the bolt 24 and is moveable, as will be discussed hereinafter in greater detail, from a position wherein a forward portion 296 of the bolt carrier 26 is positioned rearwardly of a pair of locking lug engagement surfaces 300, to a position wherein the forward portion 296 is positioned between the engagement surfaces 300 with a firing pin 316 disposed on the bolt carrier 26 slightly protuding through a co-axial opening 318 in the bolt face 288 for engagement with a shell primer, not shown.

Figure 2:
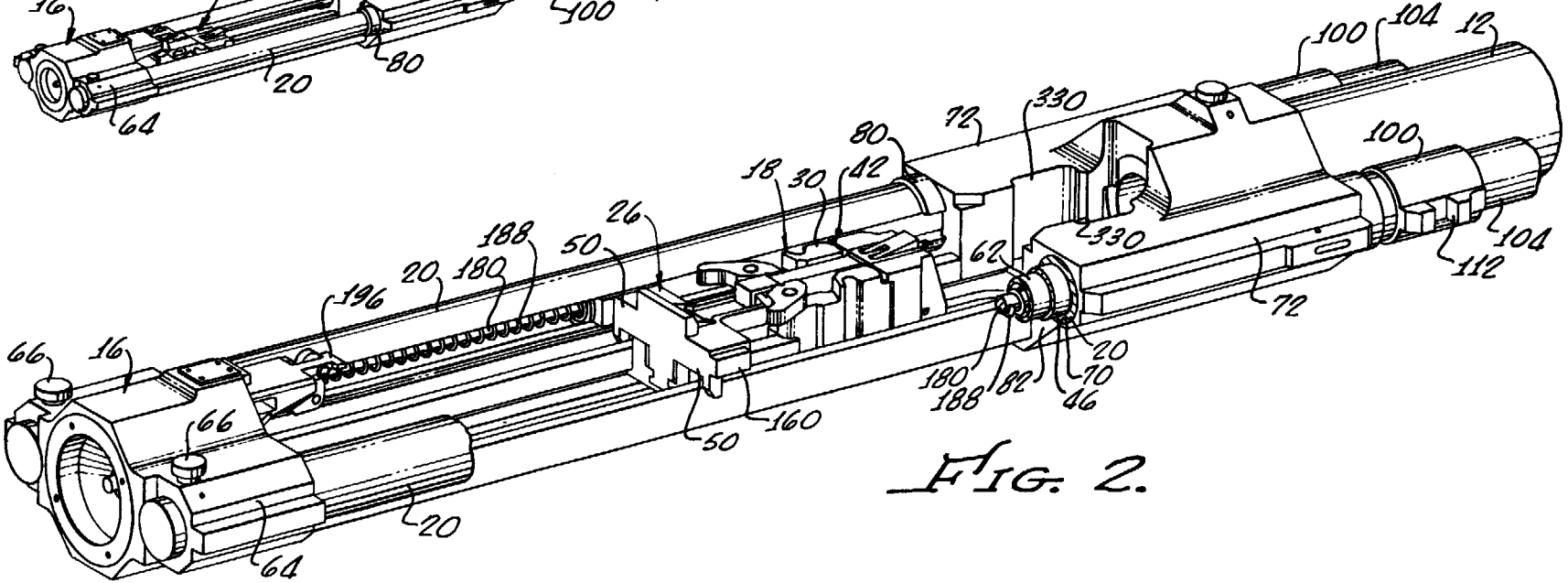

Briefly, the locking lugs 30 are pivotly mounted on the bolt 24 and have exterior faces 328 which are configured for engaging mating recesses 330 formed in the breech 14 (FIG. 2). A pair of ears 332 formed on a rearward portion 334 of the locking lugs 20 project inwardly and into engagement with an opening 336 in the bolt carrier to prevent upward movement of the locking lugs upon assembly of the bolt 24, locking lugs 30 and the bolt carrier 26. Additionally, a pair of posts 342 project upwardly for pivotally mounting the actuator members 282. The actuation members have ears 344 for engaging an opening 346 in the ejector member 280 which is slidably mounted to the bolt by a pair of flanges 348 which engage mating slots 350 in the bolt 24. Upon assembly the locking lugs 30, are restricted in vertical movement by the ears 332, and in horizontal or lateral movement by the actuation members 282, and a pair of concave surfaces 352, formed in the bolt 24, which engage the rearward portions 334 of the lugs.

It is to be appreciated that the locking lugs engagement surfaces 300 and engagement surfaces 354 on the bolt carrier forward portion 296 have a mating relationship configured so that as the surfaces 300, 354 engage during forward movement of the bolt carrier 26, they maintain continuous contact until the bolt carrier slides therebetween.

In other words, the engagement surfaces 300, 354 are operative for causing the locking lugs 30 to rotate about pivot axes 358 with increasing velocity as the bolt carrier 26 moves forwardly toward the breech 14.

FIG. 13 shows in a sequential or "strobe like" manner several relative positions of the bolt carrier 26 and one of the locking locks 30, and also illustrates a layout method for forming the engagement surfaces 300, 354. The locking lugs being mirror images of one another, only one locking lock is shown to simplify the presentation.

The bolt carrier forward portion 296 is shown in five positions: a first position being designated by a solid line 360 showing the bolt carrier surface 352 just beginning to bear on the locking lugs surface 300; second, third and forth intermediate positions, shown as dashed lines, 362, 364, 366, showing in stepwise fashion, forward movement of the bolt carrier 26 relative to the locking lugs 30 causing rotation of the locking lug 30 in a direction shown by the arrow 370; and, a last bolt carrier position, shown by the phantom line 372, wherein the locking lug has moved to an extreme position and continued movement of the bolt carrier ceases to cause rotation of the locking lugs. At this point the locking lug engagement surface 300 has reached a position as indicated by the phantom line 378.

Rotational positions of the locking lug 30 corresponding to the translational positions of the bolt carrier 26 are shown with respect to a breech engaging portion 380 of the locking lug 30, with a solid line 382 indicating the position of the lug 30 corresponding to the bolt carrier first position 360; dashed lines 384, 386, 388 corresponding to intermediate bolt carrier positions 362, 364, 366; and, a phantom line 390 corresponding to last bolt carrier position 378.

The bolt carrier engagement surface 354 is generally a rounded surface which may initially engage the locking lug surface 300 at a normal, or 90°, angle. It is to be appreciated that while any suitable overall locking lock shape or envelope, as well as pivot point 358 location, with respect to the breech engagement portion 380, may suffice to lock the bolt assembly 18 to the breech, it is necessary to shape or contour the engagement surfaces 300, 354 so that as the bolt carrier 26 pushes the locking lugs 30 outwardly into breech engagement the rotational velocity of the locking lugs increases. In this manner the lugs 30 are accelerated continuously during contact with the bolt carrier and as such, no bouncing occurs therebetween.

Hence, as shown in FIG. 13, the incremental or stepwise movement of the bolt carrier 26 as represented by the lines 362 through 372, causes incremental rotational movement by the locking lug 30 as shown by the lines 384 through 390 with the spacing between each of the lines representing the distance moved during each represented step movement. The lines 360 through 372 are evenly spaced representing a substantially constant velocity of the bolt carrier, while the spacing between the lines 382, 384 and 384, 386 increases hence showing an increase in rotational velocity of the locking lug. The rotational velocity of the lug 30 continues to increase until the bolt carrier 26 reaches a position where it passes between the locking lugs. At this point the rotational velocity of the locking lug 30 abruptly drops off as indicated by the spacing between the lines 388 and 390.

The engagement surfaces 300, 354 may be determined by an empirical layout method utilizing two dimensional cutouts of a bolt carrier and locking lug, similar to those shown in FIG. 13, and modifying the cutout surfaces until the desired movement is achieved.

In accordance with standard machining practice certain relief cuts such as the recess 398 may be made in order to facilitate proper machining of the lug engagement surface 300 in accordance to the design determined by the hereinabove empirical method.

Operation of the Anti-Bounce Apparatus

Operation of the anti-bounce apparatus 40 for preventing the bolt carrier from bouncing from the breech is best understood with reference to FIGS. **4*b*, 14, 15, 16, and 17 wherein a complete gun firing cycle is stepwise illustrated. The firing cycle will be discussed beginning with a firing of a shell. After firing, the gas pressure generated by the exploding shell, not shown, acts through the actuator pistons 132 and the pistons 46 connected to the bolt carrier 26 to impart rearward movement to the bolt carrier as hereinbefore described (FIG. 4*b*). The bolt carrier 26 is thus moved out of an interfering position between the locking lugs 30, enabling the locking lugs to rotate out of the breech recesses 330, thereby enabling the entire bolt assembly 18** to be driven rearwardly by the residual gas pressure in the breech.

It should be appreciated that timing of the movement of the pistons 46 so as to move the bolt carrier 26 out of an interfering position between the locking lugs 30 and the movement of the bolt assembly by the residual gas pressure is critical. For example, should the bolt carrier move out of an interfering position between the locking lugs 30 due to bouncing of the bolt carrier, or premature movement of the connecting piston 46, the gas pressure in the breech, being at a relatively high level, may propell the bolt assembly 18 with destructive velocity into the buffer 16.

The actuator pistons 132, ports 136 and taps 138, are configured, as is well known in the art, to cause the connecting pistons 46 to move at the proper level of residual gas pressure so that the bolt carrier does not move out of an interfering position between the locking lugs prematurely.

FIG. 14 shows the bolt assembly 26 and connecting pistons 46 at a position where the bolt carrier 26 is impacting the buffer 16, after recoil from the breech, thus stopping rearward movement of both the bolt assembly 26 and the connecting pistons 46.

During the time when the bolt assembly and the connecting piston are moving rearwardly, inertial forces cause the weights 60 and the collets 56 to remain urged against the piston stops or shoulders 170.

When the bolt assembly and the connecting piston are stopped by the buffer, inertial forces cause the weights and collets to continue rearward movement along the piston 48 until they strike the end sleeves 48 (FIG. 15).

It should be appreciated that the impact between the bolt assembly 18 and the buffer 16 is relatively "soft" compared to the impact between the bolt assembly and the breech 14 because of the resiliency of the buffer which may return over 90% of the impact energy of the bolt assembly back to the bolt assembly as it counterrecoils. Hence, the impact is not sufficiently abrupt to cause the weights 60 to expand the collets 56 into frictional engagement with the cylinders 20.

Upon counterrecoil, inertial forces cause the inertial weights 60 and the collets 56 to remain in contact with each other and against the end sleeve 48 as the bolt assembly proceeds towards the breech and remain there until the bolt assembly impacts the breech (FIG. 16).

The moment the bolt assembly strikes the breech and stops motion of the connecting pistons 46, the inertial weights 60 and collets 56 slide forward impacting the front shoulders 170 and one another to expand the collets as hereinbefore described (FIG. 17). When the collets 56 are expanded they frictionally engage the cylinder 20 thereby momentarily locking the connecting pistons 46 and the bolt carrier 26 to prevent any significant bouncing of the bolt carrier thereby ensuring that the bolt carrier forward portion 296 will not move out of an interfering position between the locking lugs 30.

It is to be appreciated that the time between impact of the bolt carrier 26 and the time the weights 60 and collets 56 reach the shoulder 170 and are thus expanded will vary from cannon to cannon and depend on many factors including the firing rate of the cannon, the mass of the bolt carrier and the like.

Turning now to the operation of the apparatus 42 for preventing bouncing between the locking lugs 30 and the bolt carrier 26 it should be recognized, as pointed out hereinbefore, that the interaction between the bolt carrier 26 and the locking lugs 30 is particularly important when the bolt carrier 26 is being moved into engagement with the breech 14 upon commencement of firing wherein the movement of the bolt assembly 26 is slower.

As hereinbefore described in connection with structural configuration of the engagement surfaces 300 and 354, the bolt carrier 26 must engage the locking lugs in a smooth manner to avoid bouncing of the locking lugs 30 off the bolt carrier forward portion and into the breech recesses because the lugs 30 will bounce out of the recesses and back into second and repeated, impacts eith the bolt carrier thus impeding its forward motion which may prevent the firing pin from engaging a shell 402 (FIGS. 18, 19, 20) in the breech 14 with sufficient impact to detonate it.

FIG. 18 shows the bolt carrier forward portion 296 in a position where the engagement surface 354 has just begun to interact with the locking lug engagement surfaces 300 to cause the locking lugs 30 to rotate about the pivot points 358 (Arrows 406) to drive the locking lug breech engagement portion 380 into the breech recesses 330 as the bolt carrier 26 moves forwardly (Arrow 408) toward the breech 14.

As hereinabove described in greater detail in connection with FIG. 13, the engagement surfaces 300, 354 are formed to prevent bouncing therebetween. This is particularly important upon initial contact between the bolt carrier 26 and locking lugs 30 because the relative velocity between the bolt carrier and the locking lugs is greatest at that time. Further, if bouncing should occur at this point, there may be sufficient time, before the bolt carrier 26 closes on the breech 14, for repeated impacts between the bolt carrier and the lugs 30 which would continue to slow the bolt carrier.

FIG. 19 shows an intermediate position wherein the lug engagement portions 380 have been driven farther into the breech recesses 330, and FIG. 20 shows the bolt carrier 26 intermediate the locking lugs 30, thereby preventing their withdrawal from the breech 14 and ensuring a positive lock. At the foremost position shown, the firing pin 316 strikes the shell 402 causing ignition thereof and subsequent recoil of the bolt assembly as hereinabove discussed.

Although there has been described above particular anti-bounce apparatus in accordance with the invention for the purpose of illustrating the manner in which the invention may be used to advantage, it will be appreciated that the invention is not limited thereto. Accordingly, any and all modifications, variations or equivalent arrangements which may occur to those skilled in the art, should be considered to be within the scope of the invention as defined in the appended claims.

What is claimed is:

1. For an automatic cannon having a breech and a bolt assembly mounted for axially reciprocating movement to and from the breech, the bolt assembly including a bolt and a bolt carrier mounted thereto for relative axial movement therewith and locking means for locking the bolt to the breech during firing, the bolt carrier preventing unlocking of the locking means when the carrier is forwardly relative to the bolt, bolt assembly anti-bounce apparatus, which comprises:

a member connected to the bolt carrier for reciprocating movement therewith;

frictional locking means disposed, when the bolt carrier is proximate to the breech, between said member and portions of the cannon fixed to the breech; and, inertial means, responsive to forward impact by the bolt carrier with the breech, for causing the frictional locking means to instantaneously lock said member to said portions of the cannon fixed to the breech to substantially prevent bouncing of the bolt carrier from breech, whereby premature and erratic unlocking of the locking means is prevented.

2. For an automatic cannon having a breech and a bolt assembly mounted for axially reciprocating movement to and from the breech, the bolt assembly including a bolt and a bolt carrier mounted thereto for relative axial movement therewith and locking means for locking the bolt to the breech during firing, the bolt carrier preventing unlocking of the locking means when the carrier is forwardly relative to the bolt, bolt assembly anti-bounce apparatus, which comprises:

a member connected to the bolt carrier for reciprocating movement therewith;

frictional locking means including a radially movable element mounted for axial sliding movement along the member and disposed, when the bolt carrier is proximate to the breech, between said member and portions of the cannon fixed to the breech, said frictional locking means being responsive to impact forces for radially moving into frictional locking engagement with said portions of the cannon fixed to the breech; and inertial means, including a weighted element mounted for axial sliding movement along said member rearwardly of said radially movable element and responsive to forward impact by the bolt carrier with the breech, for impacting the radially movable element to instantaneously lock said member to said portions of the cannon fixed to the breech to substantially prevent bouncing of the bolt carrier from breech, whereby premature and erratic unlocking of the locking means is prevented.

3. The anti-bounce apparatus according to claim 2, wherein a plurality of the weighted elements and a plurality of radially expandable elements are axially slidably mounted to said member, one of said expandable elements being disposed between adjacent ones of the weighted elements, a plurality of axially spaced apart locking engagements between the expandable elements and radially adjacent surfaces being thereby caused when the bolt carrier impacts the breech.

4. The anti-bounce apparatus according to claim 1, wherein said member includes a forward stop and wherein the frictional locking means and inertial means includes, in combination, a composite weighted element mounted to the member, rearwardly of the stop, for axial sliding movement therealong, said composite weighted element having a radially expandable forward portion responsive to forward inertial impact against said stop, when the bolt carrier impacts the breech for radially expanding into frictional engagement with said portion of the cannon fixed to the breech.

5. For an automatic cannon having a breech and a bolt assembly mounted for axially reciprocating movement to and from the breech, the bolt assembly including a bolt and a bolt carrier mounted thereto for relative axial movement therewith and locking means for locking the bolt to the breech during firing, the bolt carrier preventing unlocking of the locking means when the carrier is forwardly relative to the bolt, bolt assembly anti-bounce apparatus, which comprises:

first and second members connected to the bolt carrier for reciprocating movement therewith;

frictional locking means disposed, when the bolt carrier is proximate to the breech, between the first member and first portions of the cannon fixed to the breech, and between the second member and second portions of the cannon fixed to the breech; and, inertial means, responsive to forward impact by the bolt carrier with the breech, for causing the frictional locking means to instantaneously lock the first and second said members to said first and second cannon portions, respectively, to substantially prevent bouncing of the bolt carrier from breech, whereby premature and erratic unlocking of the locking means is prevented.

6. The anti-bounce apparatus according to claim 5, wherein said portions fixed to the breech include first and second elongate, laterally spaced apart tubular supports having means for guiding reciprocating movement of the bolt carrier, and wherein said first and second members are disposed, respectively, within said first and second supports.

7. For an automatic cannon having a breech and a bolt assembly mounted for axially reciprocating movement to and from the breech, the bolt assembly including a bolt and a bolt carrier mounted thereto for relative axial movement therewith and locking means for locking the bolt to the breech during firing, the bolt carrier preventing unlocking of the locking means when the carrier is forwardly relative to the bolt, bolt assembly anti-bounce apparatus, which comprises:

first and second elongate cylindrical pistons connected to the bolt carrier for reciprocating movement therewith, said pistons extending substantially forwardly of the bolt carrier and having stops at forward ends thereof;

frictional locking means including at least one tubular, radially expandable element disposed around each of said pistons for axial sliding movement therealong rearwardly of said stops and, disposed, when the bolt carrier is proximate to the breech, between each of said first and second pistons and portions of the cannon fixed to the breech; and, inertial means, including at least one tubular weighted element disposed around each of said pistons for axial sliding movement therealong rearwardly of said expandable element and said stop and responsive to forward impact by the bolt carrier with the breech, for causing the frictional locking means to instantaneously lock said first and second pistons to said cannon portions, fixed to the breech, to substantially prevent bouncing of the bolt carrier from breech, whereby premature and erratic unlocking of the locking means is prevented.

8. The anti-bounce apparatus according to claim 7, wherein the radially expandable elements include means defining an axial slot and wherein forward ends of the weighted elements and rearward ends of the expandable elements are configured for causing the rearward end of the expandable element to ramp up over the forward end of the rearwardly adjacent weighted element in response to forward impact thereagainst when the bolt carrier impacts the breech, radial expansion of the expandable elements into frictional locking engagement with inner surfaces of the tubular supports being thereby caused, whereby the bolt carrier is temporarily locked to the pistons at the instant of firing the cannon.

9. The anti-bounce apparatus according to claim 7, wherein the weighted element and expandable element associated with each of the members comprises an elongate tubular composite element having means defining at least one longitudinal slot in forward regions for enabling radial expansion thereof in response to impact against the associated stops when the bolt carrier impacts the breech, into frictional locking engagement with inner surfaces of the associated tubular support to prevent bolt carrier bouncing.

10. For an automatic cannon having a breech and a bolt assembly mounted for axially reciprocating movement to and from the breech, the bolt assembly including a bolt and a bolt carrier mounted thereto for relative axial movement therewith, bolt assembly anti-bounce apparatus, which comprises:

bolt-to-breech locking means including at least one locking lug pivotally mounted to the bolt, means defining a corresponding recess in the breech for receiving a locking portion of the locking lug, means defining portions of the bolt carrier for engaging corresponding portions of the locking lug to cam the locking portions thereof outwardly into the breech recess in response to continued forward movement of the bolt carrier after the bolt has impacted the breech, and means defining mating engagement surfaces on said bolt carrier and locking lug portions, said engagement surfaces being shaped to cause said bolt carrier and locking lug to maintain engagement during said camming outwardly of the locking portions;

a member connected to the bolt carrier for reciprocating movement therewith;

frictional locking means disposed, when the bolt carrier is proximate to the breech, between said member and portions of the cannon fixed to the breech; and, inertial means, responsive to forward impact by the bolt carrier with the breech, for causing the frictional locking means to instantaneously lock said member to said portions of the cannon fixed to the breech.

11. The anti-bounce apparatus according to claim 10, wherein said engagement surfaces are predetermined for causing pivotal movement of the locking lug at increasing rotational velocity during said camming outwardly.

12. The anti-bounce apparatus according to claim 10, wherein first and second, laterally spaced apart locking lugs are pivotally mounted to the bolt in a symmetrical manner and wherein, as the bolt carrier causes the locking portions of the locking lugs outwardly into the breech recesses, forward portions of the bolt carrier move forwardly between the locking lugs to prevent retraction of the locking portions from the breech recesses, and wherein the mating engagement surfaces are predetermined to cam the locking lug portions outwardly at increasing rotational velocity to prevent bouncing of the locking portions out of the breech recesses, pinching of the bolt carrier forward portions between the lugs and slowing bolt carrier forward movement into firing engagement with a chambered shell being thereby prevented.

* * * * *